United States Patent [19]

Koshinaka et al.

[11] Patent Number: 4,799,439

[45] Date of Patent: Jan. 24, 1989

[54] DOUBLE PURPOSE LOOPER FOR OVERLOCKING SEWING MACHINE

[75] Inventors: Osamu Koshinaka; Yoshikazu Suzuki, both of Osaka, Japan

[73] Assignee: Maruzen Sewing Machine Co., Ltd., Osaka, Japan

[21] Appl. No.: 397,079

[22] Filed: Jul. 12, 1982

[30] Foreign Application Priority Data

Jul. 14, 1981 [JP] Japan ..... 56-111569
Oct. 26, 1981 [JP] Japan ..... 56-161673[U]

[51] Int. Cl.[4] ..... D05B 1/20; D05B 57/06; D05B 1/10

[52] U.S. Cl. ..... 112/162; 112/168; 112/199

[58] Field of Search ..... 112/16, 162, 166, 168, 112/199

[56] References Cited

U.S. PATENT DOCUMENTS

| | | | |
|---|---|---|---|
| 425,722 | 4/1890 | Amborn, Jr. | 112/54 |
| 591,383 | 10/1897 | Collins | 112/162 |
| 703,812 | 7/1902 | Onderdonk | 112/166 |
| 836,250 | 11/1906 | Haase | 112/157 |
| 967,804 | 8/1910 | Merritt et al. | 112/162 |
| 1,256,271 | 2/1918 | Seymour | 112/162 |
| 1,293,560 | 2/1919 | Seymour | 112/162 |
| 1,304,861 | 5/1919 | Dubois et al. | 112/162 |
| 1,443,084 | 1/1923 | Moffatt et al. . | |
| 1,548,909 | 8/1925 | Seymour . | |
| 1,640,201 | 8/1927 | Maier | 112/162 |
| 1,663,488 | 3/1928 | Berger . | |
| 1,748,052 | 2/1930 | Becker . | |
| 1,769,058 | 7/1930 | Gruman . | |
| 1,864,391 | 6/1932 | Zeier . | |
| 1,864,393 | 6/1932 | Zeier et al. . | |
| 1,929,323 | 10/1933 | Maier . | |
| 2,023,316 | 12/1935 | Ebert | 112/162 |
| 2,033,693 | 3/1936 | Duke | 112/162 |
| 2,046,928 | 7/1936 | Riviere et al. | 112/199 |
| 2,439,332 | 4/1948 | Becker | 112/199 |
| 2,482,079 | 9/1949 | Zeier | 112/199 |
| 2,812,735 | 11/1957 | Nelson | 112/199 |
| 3,065,717 | 11/1962 | Reimer | 112/165 |
| 3,116,706 | 1/1964 | Sigoda | 112/162 |
| 3,121,413 | 2/1964 | Sigoda | 112/200 |
| 3,145,672 | 8/1964 | Marforio | 112/162 |
| 3,353,510 | 11/1967 | Reeber et al. | 112/162 |
| 3,373,706 | 3/1968 | Arnstead, Jr. | 112/162 |
| 3,395,660 | 8/1968 | Lewis, Jr. et al. | 112/123 |
| 3,563,194 | 2/1971 | Conti | 112/199 X |
| 3,670,677 | 6/1972 | Hirayama | 112/199 |
| 3,753,410 | 8/1973 | Kostenowczyk | 112/199 |
| 3,885,509 | 5/1975 | Cox | 112/162 X |
| 3,952,674 | 4/1976 | Hirayama | 112/199 |
| 4,117,792 | 10/1978 | Navlyt | 112/433 |
| 4,237,804 | 12/1980 | Hirayama | 112/168 |
| 4,267,786 | 5/1981 | Hanyu et al. | 112/168 |

*Primary Examiner*—Wm. Carter Reynolds
*Attorney, Agent, or Firm*—Welsh & Katz, Ltd.

[57] ABSTRACT

A looper for a sewing machine capable of making overlocked stitches has a unitary distal portion which is operable for the selective production of overlocked stitches with one needle and three threads or one needle and two threads. The unitary distal portion of the looper includes an upper looper portion and a spreader portion. A holder is provided in connection with driving means for supporting the looper, and a positioning arrangement is provided to selectively position the unitary distal portion of the looper in a first position for movement along a first path or in a second position for movement along a second path for the selective production of the stitches.

13 Claims, 3 Drawing Sheets

DOUBLE PURPOSE LOOPER FOR OVERLOCKING SEWING MACHINE

BACKGROUND OF THE INVENTION

The present invention relates to a looper for use in an overlocking sewing machine, and more particularly to a double-purpose looper capable of forming overlocked stitches with one needle and two threads and one needle and three threads.

Conventional overlocking sewing machines for producing overlocked stitches with one needle and three threads include a sewing needle, a lower looper and an upper looper secured to a looper holder, which cooperate to form such overlocked stitches. Overlocking sewing machines for forming overlocked stitches with one needle and two threads have a sewing needle, a lower looper and a spreader, which are cooperatively actuatable to produce such overlocked stitches.

In the conventional machine, as many differently shaped loopers and spreaders are needed as the stitches produced by their use. Formation of overlocked stitches with one needle and three threads or one needle and two threads on a single sewing machine requires two different loopers which are to be replaced with each other as demands dictate, an arrangement which is quite tedious and time-consuming.

Recently, as seen in U.S. Pat. No. 4,237,804 a sewing machine was proposed for stitching fabric edges with an overlocked stitch with one needle and three threads, the sewing machine including an upper looper and a separate movble member attached thereto, which together define a hook portion for overcasting a fabric edge with one needle and two threads as with a single spreader. When forming overlocked stitches with one needle and three threads, the movable member is brought away from the upper looper to release the hook portion and allow the upper looper to function as intended. In this machine, the combined hook portion moves along the same path as that of the upper looper when forming overlocked stitches with one needle and three threads, so that the hook portion and the upper looper will meet a lower looper at the same position to produce the respective stitches. The separate movable member which is necessary to cooperate with the upper looper in providing the combined hook portion for formation of overlocked stitches with one needle and two threads must be retracted, when not in use, into a position in which the movable member does not interfere with operation of the sewing machine, and hence a space must be reserved for retracting the movable member therein. Furthermore, when the combined hook portion picks up a thread from the lower looper, the thread therefrom tends to be caught in a gap defined between the upper looper and the separate movable member.

Thus, the known overlocking sewing machines even with the combined hook portion upper looper and movable member, are unable to form overlocked stitches of at least two types, reliably and smoothly, while permitting the change between stitch types to be quickly made.

It is therefore an object of the present invention to solve the foregoing problems encountered with the prior apparatus by providing a single looper element which enables the production of both one needle, three thread overlocked stitches and one needle, two thread overlocked stitches upon cooperation with a needle and a lower looper in a sewing machine.

This object and other objects, features and advantages of the present invention will become apparent from the following description when considered in connection with the accompanying drawings.

SUMMARY OF THE INVENTION

In general, the objects and advantages of the present invention are achieved by providing an improved looper having a unitary distal portion which serves as an upper looper and as a spreader, thus serving the functions of two different elements. In the present invention, the upper portion of the distal portion of the improved looper serves as an upper looper to produce overlocked stitches with one needle and three threads while the lower portion of the distal portion of the improved looper serves as a spreader for producing overlocked stitches with one needle and two threads. The unitary distal portion of the improved looper, includes upper and lower distal end portions jointly defining a hook portion therebetween. The hook portion can be considered to be a spreader portion which is operable to function as a spreader as described herein. The unitary distal portion preferably is curved toward the lower looper in the sewing machine, and is operable with a sewing needle and a lower looper, both of which are capable of carrying threads for the selective production of overlocked stitches with one needle and three threads or one needle and two threads. The improved looper of the present invention preferably includes an aperture in its unitary distal portion which is capable of supporting a thread for movement with the looper.

The improved looper of the invention is supported by holder means, preferably a looper holder, which in turn is mounted to driving means for the looper for movement therewith. The supporting of the improved looper to the holder means and to the driving means is accomplished at least in part by positioning means mounted on said holder means or said driving means for selectively positioning the improved looper with its unitary distal portion with respect to the driving means in a first or second position at which the looper driving means drives the looper along different paths, and thereby meets the lower looper at different positions. In its first position, the unitary distal portion of the improved looper is moved by the driving means along a first path and in its second position the unitary distal portion is moved along a second path. As will be hereinafter described, the positioning of the improved looper with its unitary distal portion in either of the two positions and moving the portion along the respective paths will determine the formation of overlocked stitches with either one needle and three threads or one needle and two threads.

Upon movement along one of its two paths, the improved looper, in cooperation with a needle carrying a thread and a lower looper also carrying a thread, will serve as an upper looper to pick up the lower looper thread for producing, with a third thread carried by it, overlocked stitches with one needle and three threads; while upon movement along the other of its two paths, the improved looper, again in cooperation with the needle and lower looper, each carrying a thread, will serve as a spreader having a front hook portion to catch and retain the lower looper thread for forming overlocked stitches with one needle and two threads.

More specifically, the improved looper in the first position is movable to cause the distal or hook portion to move along one path across the lower looper for forming, with a thread carried by the improved looper, an overlocked stitch with one needle and three threads, and the improved looper in the second position is movable to cause the distal or hook portion to move along a second path across the lower looper so as to pick up and spread a lower thread loop from the lower looper for forming an overlocked stitch with one needle and two threads.

DETAILED DESCRIPTION OF THE PREFERRED EMBODIMENTS

Figure 1:
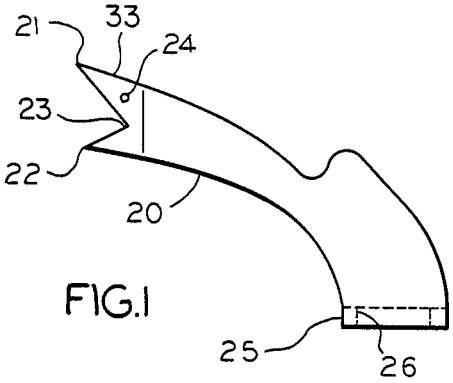
FIG. 1 is a front elevation view of a double purpose looper according to the present invention.

Referring to the drawings where like elements have the same reference numbers, and specifically to FIGS. 1–4, the numeral 20 designates generally a looper constructed in accordance with the present invention, the looper having a unitary distal end portion bifurcated with upper and lower distal end portions 21, 22 which jointly define a hook portion 23 therebetween. Lower distal end portion 22 and hook portion 23 serve as a spreader portion to catch and retain lower looper thread 56, (FIG. 14), so as to assist in forming overlocked stitches with one needle and two threads. Upper looper portion 33 formed by upper distal end portion 21 having an upper surface 34 of said unitary distal portion serves as an upper looper to produce overlocked stitches with one needle and three threads. The upper distal end portion 21 has adjacent thereto in suitable position in looper 20 an aperture 24 for passage of a thread therethrough. The distal end portions are curved toward the back of a lower looper 27 as shown.

Figure 2:
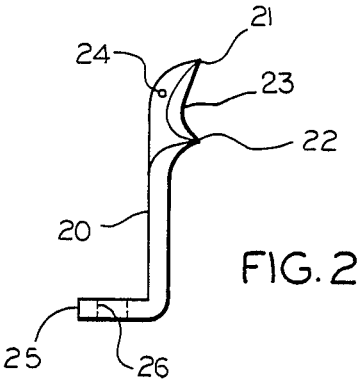
FIG. 2 is a side elevation view of the looper of FIG. 1.
Figure 3:
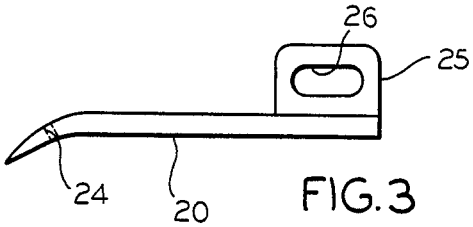
FIG. 3 is a top view of the looper shown in FIG. 1.

As best illustrated in FIGS. 2 and 3, looper 20 has a mounting flange 25 on one side of a rear or lower portion of the looper, flange 25 in this embodiment having an elongated aperture, preferably a slot, 26 extending longitudinally of the flange.

Figure 4:
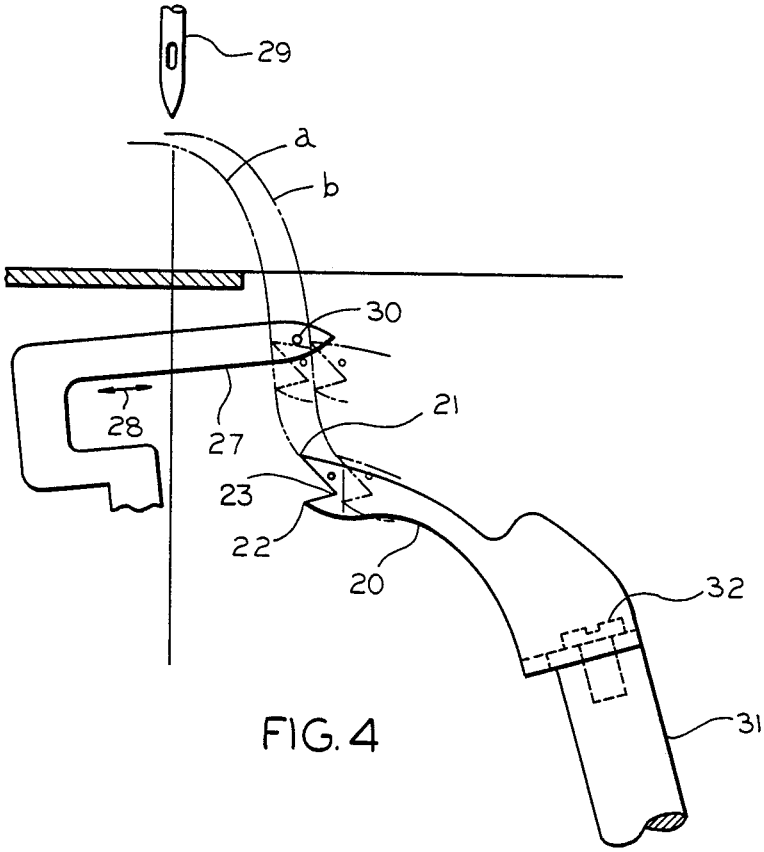
FIG. 4 is a front elevation view of the looper of FIG. 1, showing several related elements, and illustrating the paths along which the looper is moved and positions of the looper therealong in broken lines.

As shown in FIG. 4, the lower looper 27 is angularly movable about a shaft (not shown) disposed downwardly thereof for reciprocal movement in the directions of the arrows 28. A sewing needle 29 is movable downwardly in front of the lower looper 27 as it is withdrawn. The lower looper 27 has in its distal end an aperture 30 for passage of a thread therethrough.

Designated in FIG. 4 as 31 is a looper holder on which is mounted the flange 25 of the looper 20. The looper 20 is secured to the distal end portion of (as shown) looper holder 31 by a screw 32 extending through the elongated slot 26 into a threaded hole in the looper holder 31 in at least two positions which are determined by the positioning of the flange 25 on the looper holder, and screw 32 in slot 26. To selectively position looper 20 in position for the formation of overlocked stitches with one needle and three threads, the looper 20 is first moved forward toward the lower looper 28 into the solid-line position illustrated in FIG. 4 until the right end of the elongated aperture 26 abuts against the screw 32. The looper 20 is then fixed to the looper holder 31 by tightening the screw 32. In order to selectively position looper 20 in position for the formation of overlocked stitches with one needle and two threads, the screw 32 is loosened to allow the looper 20 to be retracted on the looper holder 31 until the left end of the elongated aperture 26 abuts against the screw 32. Then, the screw 32 is tightened to fix the looper 20 to the looper holder 31.

FIGS. 5–8 illustrate another embodiment of the present invention, reference numeral 40 generally designating the improved looper thereof with its unitary distal end portion. The unitary distal end portion of looper 40 is bifurcated with upper and lower distal portions 21, 22 jointly defining a hook portion 23 therebetween, and is curved toward the back of the lower looper 27. The looper 40 includes an aperture 24 for receiving a thread in the manner described above. Further in this embodiment, looper 40 is mounted on a looper holder 41, which in turn is fixedly mounted to an elongated member 42 of the looper driving means. Thus, whereas in the first embodiment, the elongated member served as the looper holder 31 to which looper 20 was mounted, in this embodiment the flanged member 41 serves as the looper holder to which looper 40 is mounted and which in turn is mounted on the elongated member 42.

Looper 40 has in its portion distant from the unitary distal end described above, a horizontally elongated aperture 43 through which a screw 44 extends into threaded engagement in a threaded hole in the looper holder 41. The looper 40 can be selectively positioned thereon by advancing the looper 40 to a first position or retracted to a second position upon loosening the screw 44, and can be secured in place in the first or second position by tightening the screw 44. To selectively position looper 40 in position for the formation of overlocked stitches with one needle and three threads, the looper 40 is displaced toward the lower looper 27 into the first solid-line position, in which the looper 40 is fastened by the screw 44. In order to selectively position looper 40 in position for the formation of over-locked stitches with one needle and two threads, screw 44 is loosened to allow looper 40 to be retracted on looper holder 41 away from lower looper 27, and the screw 44 then tightened.

Figure 8:
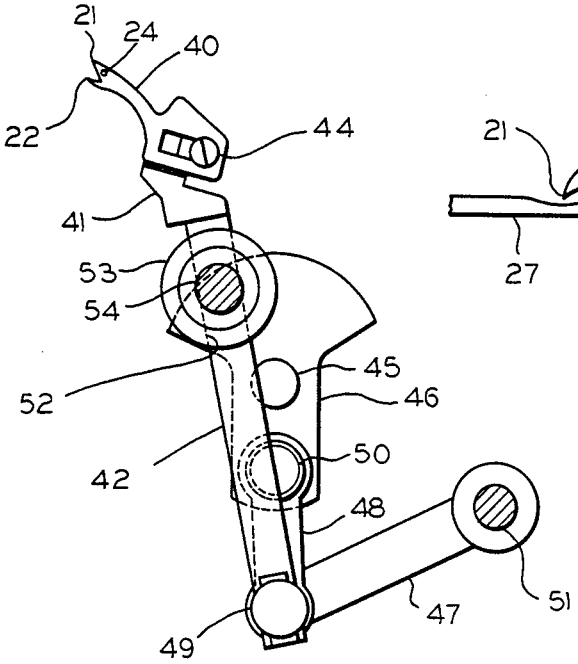
FIG. 8 is a front elevation view of the looper of FIG. 5 illustrating supporting elements and a portion of the driving means for the looper of the present invention.

FIG. 8 shows apparatus for driving a looper of the present invention. Although looper 40 is utilized in FIG. 8, the apparatus applies as well to looper 20. The driving apparatus comprises a drive shaft 45 located in a lower portion of the sewing machine, a crank 46 fixed to the shaft 45, and a swingable lever 47 connected at its distal end to one end of a connector link 48 by a pin 49. The other end of connector link 48 is connected by a pin 50 to an end of the crank 46. The swingable lever 47 is connected at its proximal end thereof to a shaft 51 rotatably journalled in a bearing (not shown) disposed downwardly of a bed of the sewing machine.

The looper holder 31 in the embodiment of FIGS. 1–4 is in the form of an elongated rod to which flange 25 is mounted, whereas in FIG. 8 the elongated member 42 is an element of the driving apparatus. Thus, looper holder 31 can be considered in relation to FIG. 8 as 42 and, like member 42, as having a lower end rotatably coupled to pin 49 and having an intermediate portion slidably inserted through a guide hole 52 in a guide member 53 that is angularly movably mounted on shaft 54 attached to a support (not shown) disposed downwardly of the sewing machine bed.

Figure 5:
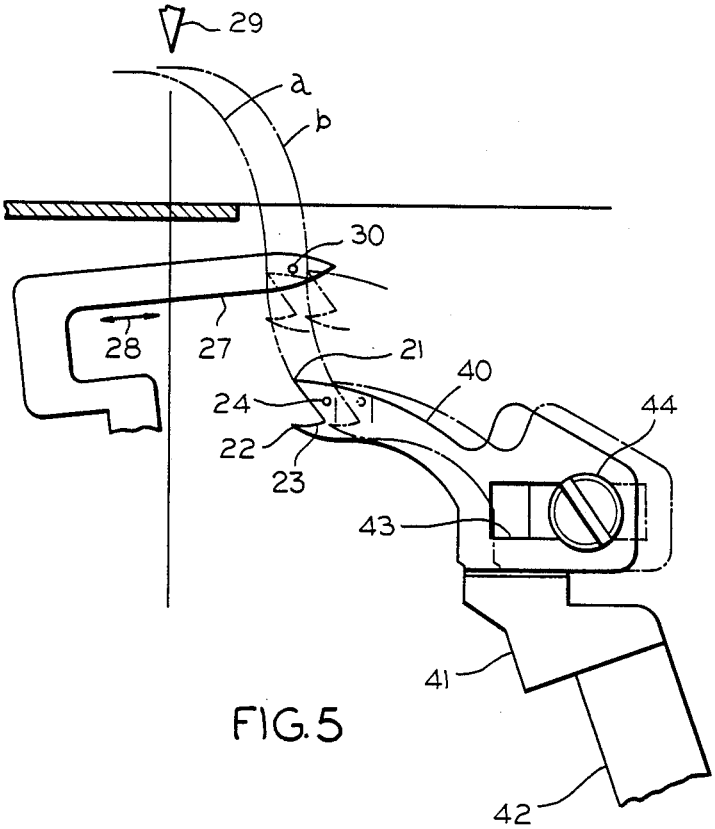
FIG. 5 is a front elevation view of another embodiment according to the present invention illustrated as in FIG. 4.
Figure 6:
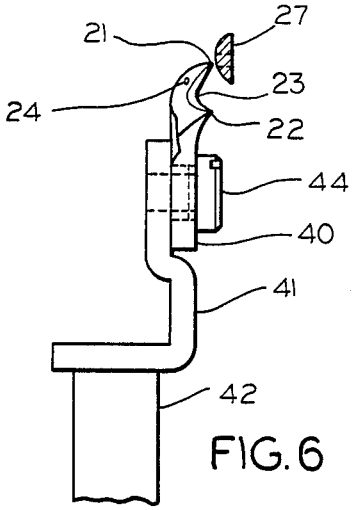
FIG. 6 is a side elevation view of the looper shown in FIG. 5.
Figure 7:
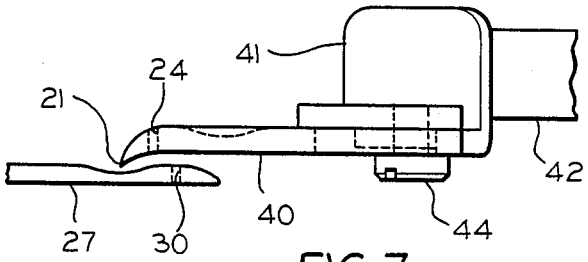
FIG. 7 is a top view of the looper of FIG. 5.

When the drive shaft 45 rotates, the lever 47 is caused by the connector link 48 to turn about the shaft 51, whereupon the elongated member 42 moves up and down as it swings about the shaft 54 causing the upper and lower distal ends 21, 22 of the looper to follow the path a or b shown in FIGS. 4 and 5.

The manner in which the looper 20, 40 of the invention is utilized to form an overlocked switch with one needle and three threads will now be described.

With the looper 20, 40 selectively positioned in the first solid line position in FIGS. 4 and 5, as described above, an upper thread 55 is threaded through the hole 24 in the looper 20, 40, a lower thread 56 is threaded through the hole 30 in the lower looper 27, and a sewing thread 57 is threaded through a thread hole in the sewing needle 29.

Figure 9:
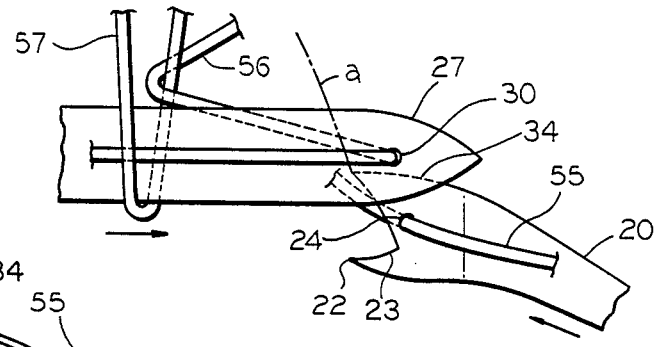
FIG. 9 is an enlarged front elevation view illustrating one step in the formation of a three thread stitch with the looper of the present invention.
Figure 10:
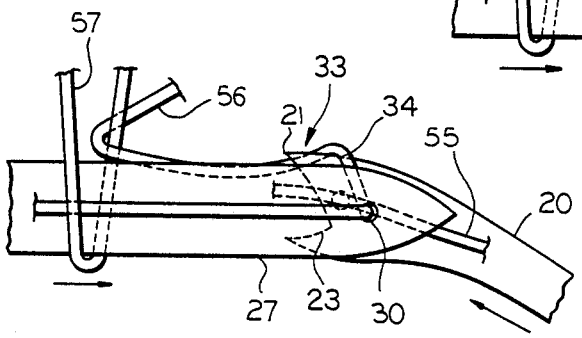
FIG. 10 is an enlarged front elevation view of another step in the formation of a three thread stitch with the looper of the present invention.
Figure 11:
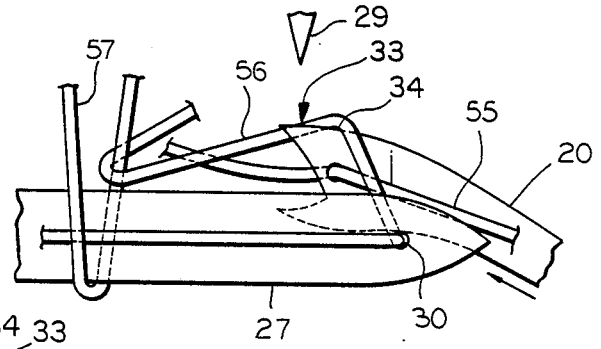
FIG. 11 is an enlarged front elevation view of still another step in the formation of a three thread stitch with the looper of the present invention.

As the sewing machine is put into operation, the upper distal end portion 21 of the looper 20, 40 moves along the path a as the distal end portion 21 traverses the lower looper 27. At this time, the upper distal end portion 21 passes under the lower thread 56 as shown progressively in FIGS. 9, 10 and 11, and is raised with the lower thread 56 carried on upper surface 34. The looper 20, 40 continues to move upwardly to pass the upper thread 55 extending through the hole 24 under the lower thread 56 and until the upper thread 55 meets the sewing needle 29. The upper thread 55 is now caught by the sewing needle 29 as the latter is lowered. Thereafter, the looper 20, 40 is moved downwardly and the lower looper 27 is retracted forming an overlocked stitch with one needle and three threads (Japanese Industrial Standards: Classification B9070, Identification E13, E13A).

The manner in which the looper 20, 40 of the invention is utilized to form an overlocked stitch with one needle and two threads will now be described.

The looper is retracted to the second, broken line position in FIGS. 4 and 5 and secured in that position as heretofore described. In this position, the driving apparatus will cause the upper distal end portion 21 and hook portion 23 to follow the path b across the lower looper to form an over-locked stitch with one needle and two threads.

Figure 13:
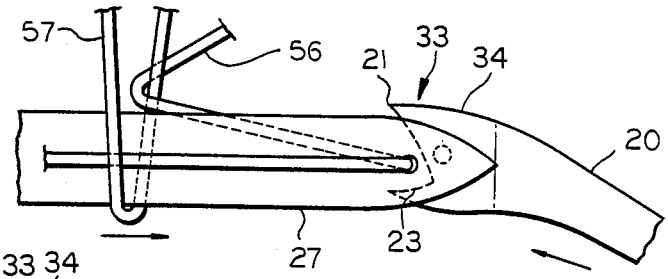
FIG. 13 is an enlarged front elevation view of another step in the formation of a two thread stitch with the looper of the present invention.
Figure 14:
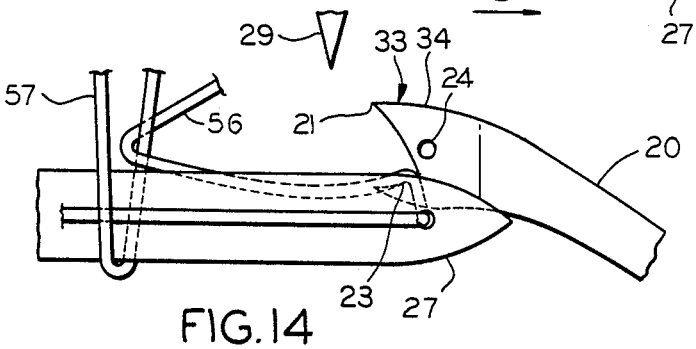
FIG. 14 is an enlarged front elevation view of still another step in the formation of a two thread stitch with the looper of the present invention.

The sewing machine is operated with the lower thread 56 and the needle thread 57, but without the upper thread 55 in the looper 20, 40. The hook portion 23 of the distal portion of the looper 20, 40 as it moves upwardly picks up the lower thread 56 extending through the lower looper 27 as shown successively in FIGS. 12, 13 and 14. The looper 20, 40 continues to move upwardly with the lower thread 56 retained in hook portion 23, i.e. between the distal end portions 21, 22, and more particularly by lower distal end portion 22 as shown in FIG. 14, until the lower thread 56 is taken by the sewing needle 29 as the latter descends. The looper 20, 40 and the lower looper 27 are then retracted to form an overlocked stitch with one needle and two threads (Japanese Industrial Standards: Classification B9070, Identification E12, E12A).

Figure 12:
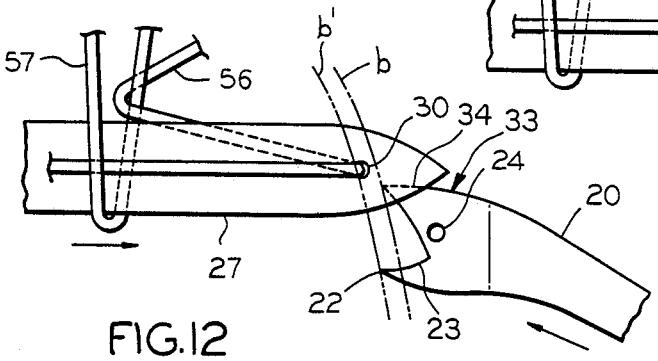
FIG. 12 is an enlarged side elevation view illustrating one step in the formation of a two thread stitch with the looper of the present invention.

Stated otherwise, the upper distal end portion 21 of the looper 20, 40 moves along the path b which is different from the path described by the upper distal end portion 21 as it is in the first position, as shown in FIGS. 4 and 5, and hence the upper distal end portion 21 does not move into the lower thread 56 carried by the lower looper 27. Instead, the lower distal end portion 22 portion follows a path b′, as illustrated in FIG. 12, to pick up the lower thread 56, thus producing an overlocked stitch with one needle and two threads.

The looper 20, 40 of the present invention can be attached to the looper holder 31, 41, respectively, at front and rear positions with little difficulty, such that the looper will move across the lower looper 27 at different positions. When the looper 20, 40 is in the forward position, the looper serves as an upper looper in a sewing machine for forming overlocked stitches with one needle and three threads, and when the looper 20, 40 is in the rearward position, the looper serves as a spreader in a sewing machine for producing overlocked stitches with one needle and two threads. The arrangement of the present invention is highly advantageous in that it can form two kinds of overlocked stitches without the expense of having two different looper elements as with earlier sewing machines.

With the present invention, as described above, the unitary looper 20, 40 is easily movable from the first to the second position or vice versa in order to cause the distal end portions 21, 22 of the distal or hook portion to traverse the lower looper at different positions for the formation of overlocked stitches with one needle and two threads or one needle and three threads.

While in the illustrated embodiments the looper 20, 40 has been shown as being movable generally horizontally, it may be arranged so as to move generally vertically between first and second positions, and various manners of movement such as angular movement or sliding movement may be employed for shifting the looper.

The looper 20, 40 moves across the lower looper 27 at different positions simply by changing paths of movement of the distal or hook portion of the looper 20, 40. The arrangement of the invention is advantageous in that no additional member for defining a hook portion with the upper looper is needed resulting in smooth and reliable formation of overlocked stitches, a construction which is different from conventional arrangements in which upper loopers move along a single, fixed path.

Since there is no need for reserving an additional space for withdrawing therein a separate member out of interference with the operation of the machine for forming overlocked stitches with one needle and three threads, as with the recently proposed apparatus, the present invention is readily applicable to small-size sewing machines having limited space available therein.

I claim:

1. An improved looper for an overlocking sewing machine including a sewing needle and a lower looper, each capable of carrying a thread, said needle, lower looper and improved looper being cooperatively operable to produce overlocked stitches, comprising:

a looper having a unitary distal portion having an upper looper portion and a spreader portion, said unitary distal portion being operable with said needle and lower looper for the selective production of overlocked stitches with one needle and three threads or one needle and two threads;

said looper including an aperture in said distal portion capable of supporting a thread for movement therewith;

said upper looper of said unitary distal portion being operable to pick up the thread carried by said lower looper and to move a thread supported by said looper, with said unitary distal portion, in its aperture under the thread carried by the said lower looper to form an overlocked stitch with a third thread carried by said needle.

2. The looper defined in claim 1, wherein the upper surface of said unitary distal portion comprises said upper looper portion.

3. The looper defined in claim 1, wherein said unitary distal portion is bifurcated and forms two distal end portions, said two distal end portions of said unitary distal portion being curved toward the lower looper.

4. An improved looper for an overlocking sewing machine including a sewing needle and a lower looper, each capable of carrying a thread, and looper driving means, said needle, lower looper and improved looper being cooperatively operable to produce overlocked stitches, comprising:

a looper having a unitary distal portion having an upper looper portion and a spreader portion, holder means mounted in connection with said driving means for supporting said looper with said unitary distal portion for movement therewith, and positioning means for selectively positioning said unitary distal portion of said looper with respect to said holder means in a first position wherein said distal portion is moved by said driving means along a first path or in a second position wherein said unitary distal portion is moved by said driving means along a second path for the selective production of overlock stitches with one needle and three threads or one needle and two threads.

5. The looper defined in claim 4, wherein said holder means includes a distal end portion to which said looper is secured.

6. The looper defined in claim 5, wherein said positioning means comprises fastening means for fastening said looper to said holder means in at least two positions corresponding to said first and second positions of said looper.

7. The looper defined in claim 6, wherein said looper includes a flange and said positioning means includes at least one aperture in said flange, said fastening means comprising a fastener positionable in the aperture in said flange to secure said looper to said holder means in at least two positions corresponding to said first and second positions of said looper.

8. The looper defined in claim 7 wherein the aperture in said flange is an elongated slot, said looper being positionable in a plurality of positions with respect to said holder means as determined by the elongated slot and is secured thereto in selected ones of the plurality of positions by said fastening means.

9. The looper defined in claim 8, wherein the fastening means is a screw threadedly received into a threaded hole in the holder means.

10. The looper defined in claim 5, wherein said looper is adjustably secured to said holder means in at least two positions corresponding to said first and second positions of the unitary distal portion of said looper.

11. The looper defined in claim 10 wherein said positioning means includes at least one aperture in said looper, and fastening means positionable in the aperture and securable to said holder means to secure said holder means and said looper to each other in at least two positions corresponding to said first and second positions of the unitary distal portion.

12. The looper defined in claim 11, wherein the aperture in said looper is an elongated slot and said looper is positionable in a plurality of positions with respect to said holder means as determined by said elongated slot, and is secured to said holder means.

13. The looper defined in claim 4, wherein said unitary distal portion is bifurcated and forms two distal end portions, said two distal end portions being curved toward the lower looper.

* * * * *